US010542815B2

(12) United States Patent
Rowe et al.

(10) Patent No.: US 10,542,815 B2
(45) Date of Patent: Jan. 28, 2020

(54) BACKPACK WITH IMPROVED ACCESS OPENING

(71) Applicant: ACCO Brands Corporation, Lake Zurich, IL (US)

(72) Inventors: Michael D. Rowe, Medway, OH (US); Michael A. Lorenz, Gahanna, OH (US); Thomas J. Africa, Warren, OH (US)

(73) Assignee: ACCO Brands Corporation, Lake Zurich, IL (US)

( * ) Notice: Subject to any disclaimer, the term of this patent is extended or adjusted under 35 U.S.C. 154(b) by 690 days.

(21) Appl. No.: 14/751,860

(22) Filed: Jun. 26, 2015

(65) Prior Publication Data

US 2015/0374105 A1 Dec. 31, 2015

Related U.S. Application Data

(60) Provisional application No. 62/017,506, filed on Jun. 26, 2014.

(51) Int. Cl.
*A45F 3/04* (2006.01)

(52) U.S. Cl.
CPC ..... *A45F 3/04* (2013.01)

(58) Field of Classification Search
CPC ..... A45F 3/00–08; A45F 3/10
(Continued)

(56) References Cited

U.S. PATENT DOCUMENTS 4,810,102 A 3/1989 Norton
5,004,134 A * 4/1991 Barry ..... A45C 3/10 224/235

(Continued)

FOREIGN PATENT DOCUMENTS

CA 2653277 C * 3/2014
DE 202004015475 1/2005

OTHER PUBLICATIONS

PCT, International Search Report and Written Opinion, International Application No. PCT/US2015/037909, dated Sep. 8, 2015.

*Primary Examiner* — Corey N Skurdal
(74) *Attorney, Agent, or Firm* — Fitch, Even, Tabin & Flannery LLP

(57) ABSTRACT

A backpack including a body having a back surface configured to be positioned adjacent to a back of a wearer when the backpack is worn. The body further includes a front surface at least partially spaced away from the back surface to define an inner cavity therebetween. The body has a pair of opposed side surfaces, each side surface extending between the back surface and the front surface. The backpack includes at least one shoulder strap coupled to the body and positionable over a shoulder of a wearer and a releasable fastener that is openable to provide access to the inner cavity or closable to block access to the inner cavity. The fastener extends at least partially across the front surface and both side surfaces. At least part of the releasable fastener on the side surfaces, at a position away from an outer perimeter of each side surface, extends at a non-perpendicular angle relative to the back surface. The body includes a hinge line about which the body is predetermined to bend, and the backpack is configured such that when the releasable fastener is opened the backpack includes a cover at least partially defined by the releasable fastener which is hingedly movable about the hinge line.

33 Claims, 4 Drawing Sheets

(58) Field of Classification Search
USPC ..... 224/600–659
See application file for complete search history.

(56) References Cited

U.S. PATENT DOCUMENTS

| | | | | |
|---|---|---|---|---|
| 5,927,581 | A | 7/1999 | Reddy et al. | |
| 6,015,072 | A * | 1/2000 | Young | A45C 7/0063 190/103 |
| 6,053,382 | A | 4/2000 | Wyant | |
| 8,038,042 | B2 | 10/2011 | Bartel | |
| 8,910,844 | B2 | 12/2014 | Rowe et al. | |
| 2003/0234269 | A1 | 12/2003 | Shamas | |
| 2004/0050893 | A1 * | 3/2004 | Ravinett | A45F 3/04 224/638 |
| 2004/0182901 | A1 | 9/2004 | Godshaw et al. | |
| 2004/0256431 | A1 * | 12/2004 | Chuang | A45F 3/04 224/628 |
| 2010/0108731 | A1 | 5/2010 | Rowe et al. | |
| 2013/0146627 | A1 * | 6/2013 | Kryklywicz | A45C 13/103 224/235 |
| 2013/0327662 | A1 * | 12/2013 | Loban | G10G 7/005 206/314 |

* cited by examiner

BACKPACK WITH IMPROVED ACCESS OPENING

This application claims priority to U.S. Provisional Application Ser. No. 62/017,506, filed on Jun. 26, 2014, the entire contents of which are hereby incorporated by reference.

BACKGROUND

Backpacks are widely used by students and other users to store books, school supplies, travel supplies, etc. However, in many existing backpacks it may be difficult to access the inner cavity. In particular, many backpacks utilize a single, straight-line fastener extending across the top of the backpack. However, such arrangement provides an access opening that is limited in size, thereby impeding the insertion or removal of relatively large or bulky items.

SUMMARY

In one embodiment the invention is a backpack including a body having a back surface configured to be positioned adjacent to a back of a wearer when the backpack is worn. The body further includes a front surface at least partially spaced away from the back surface to define an inner cavity therebetween. The body has a pair of opposed side surfaces, each side surface extending between the back surface and the front surface. The backpack includes at least one shoulder strap coupled to the body and positionable over a shoulder of a wearer and a releasable fastener that is openable to provide access to the inner cavity or closable to block access to the inner cavity. The fastener extends at least partially across the front surface and both side surfaces. At least part of the releasable fastener on the side surfaces, at a position away from an outer perimeter of each side surface, extends at a non-perpendicular angle relative to the back surface. The body includes a hinge line about which the body is predetermined to bend, and the backpack is configured such that when the releasable fastener is opened the backpack includes a cover at least partially defined by the releasable fastener which is hingedly movable about the hinge line.

DETAILED DESCRIPTION

Figure 2:
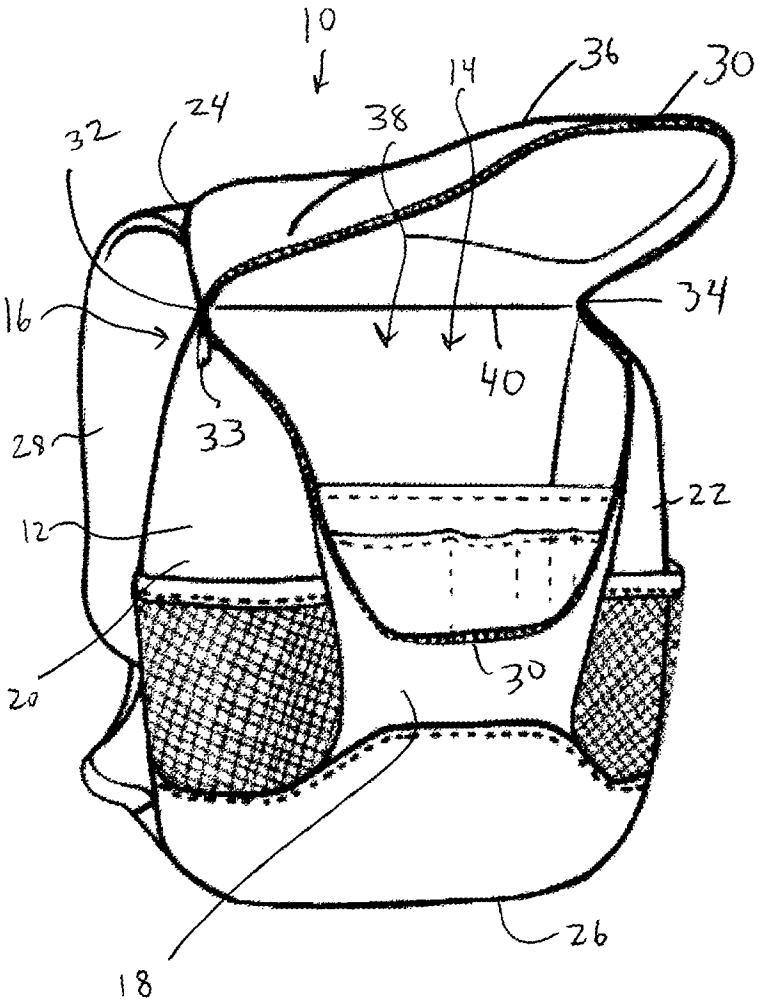
FIG. 2 is a left front perspective view of the backpack of FIG. 1, with the cover in a partially open position.
Figure 1:
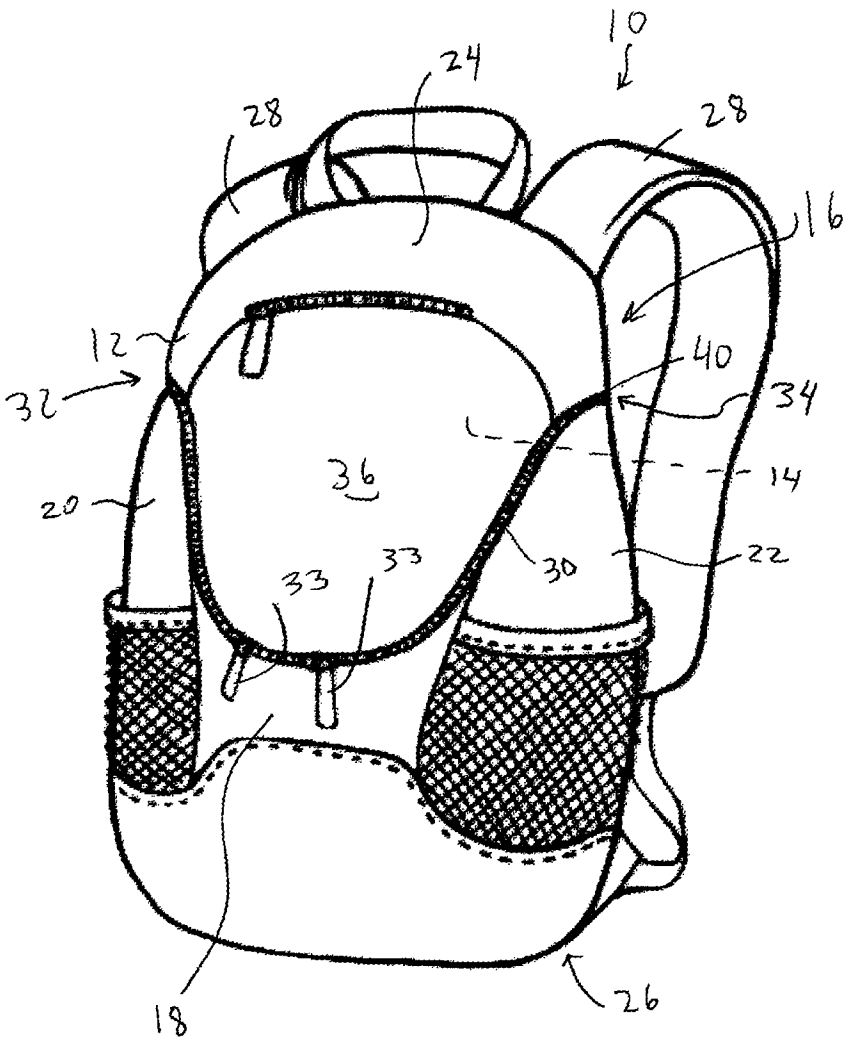
FIG. 1 is a right front perspective view of one embodiment of the backpack of the present invention, with the cover in its closed position.

The backpack 10 of the present invention can include a body 12 with an inner cavity or storage compartment 14 therein, defining a majority of an inner volume of the body 12 in one case. The body 12 can include a back surface 16 configured to be positioned adjacent to the back of a wearer when the backpack 10 is worn. In the illustrated embodiment, the back surface 16 is generally flat, planar and rectangular. In some cases the back surface can be relatively stiff such that the back surface 16 remains generally flat and planar when the backpack 10 rests on a ground surface and the back surface 16 is arranged vertically, such that the back surface 16 supports the entire body 12 in its configuration shown in FIGS. 1-8 without any external support. However, the back surface 16 need not necessarily have this stiffness, and also can take other shapes and configurations if desired.

The body 12 can further include a front surface 18 that is at least partially spaced away from the back surface 16 to define the inner cavity 14 therebetween. In some cases, the front surface 18 is generally parallel to and spaced apart from the back surface 16. The body 12 can further include a pair of opposed side surfaces 20, 22, wherein each side surface 20, 22 extends between the back surface 16 and the front surface 18, and are generally parallel to each other and perpendicular to the back surface 16 and front surface 18. The body 12 can include an upper surface 24 and a lower surface 26, wherein the upper 24 and lower 26 surfaces are parallel and opposed, and each extends between the back surface 16 and front surface 18, and also extends between the side surfaces 20, 22. The inner cavity 14 can be positioned between the back surface 16, front surface 18, side surfaces 20, 22, upper surface 24 and lower surface 26.

It should be understood that the back surface 16, front surface 18, side surfaces 20, 22, upper surface 24 and lower surface 26, although separated in some cases by a curved transition as shown in the embodiments of FIGS. 1-8, may nevertheless be relatively easy to discern such that the body 12 generally takes the form of a six-sided rectangular prism. In other cases, however, the surfaces, particularly the front surface 18, side surfaces 20, 22, upper surface 24 and/or lower surface 26 can have smoothly continuous transitions therebetween or be formed of a single curved shape, or be defined by a relatively flexible material, such that there is no sharp delineation between the surfaces. Nevertheless, in such cases the surfaces may be able to be defined or assigned based upon relative positioning relative to the back surface 16, even if such surfaces are not generally flat, planar, or clearly defined. In one case, if the backpack 10 lacks a clearly defined upper surface, the upper surface can be considered to be located in the upper 5% in one case, or 10% in another case, of the height of the front of the body 12 and, in one case, at least partially spaced away from the back surface 16.

The body 12 can further include a pair of shoulder straps 28 attached thereto. In the illustrated embodiment, shoulder straps 28 are secured to the back surface 16 at or adjacent to upper surface 24 and also secured to the back surface 16 at or adjacent to the lower surface 26. The shoulder straps 28 could also or instead be coupled to the upper surface 24, lower surface 26 or side surfaces 20, 22. The shoulder straps 28 are configured to be worn around the shoulders of a wearer to position the back surface 16 adjacent to the back of a wearer. Alternatively, if desired, rather than using two shoulder straps 28, a single shoulder strap can be utilized to provide a backpack 10 in a configuration known as a "sling." Each shoulder strap 28 can include cushioning or padding material (such as foam) thereon, and be adjustable in length, to allow the backpack 10 to be carried on the back of a wearer in a well-known manner.

The backpack 10 can include a releasable fastener 30 extending around the body 12 such that when the releasable fastener 30 is opened, access is provided to the inner cavity 14, and when the releasable fastener 30 is closed, access to the inner cavity 14 is blocked. The releasable fastener 30 can take any of a wide variety of forms, including a zipper, a slide fastener, hook-and-loop fastening material (i.e. VELCRO® fastening material), snaps, magnets and the like. In the illustrated embodiment the releasable fastener 30 takes the form of one or more zippers that can be fastened or released via a zipper pull 33.

In the embodiment of FIGS. 1-6, the releasable fastener 30 includes or defines a pair of spaced apart end points 32, 34 which are, in the illustrated embodiment, positioned on opposite sides of the back surface 16 at or adjacent to where the back surface 16 intersects the associated side panel 20, 22. The end point 32, 34 are also in this embodiment both positioned vertically below the upper extent of the back surface 16 and the upper surface 24. Beginning at the end point 32 on or adjacent the side surface 20, the fastener 30 extends away from the back surface 16 in a generally perpendicular manner, but may be angled slightly downwardly relative to the lower surface 26 as the fastener 30 extends toward the front surface 18. Upon reaching the front surface 18, the fastener 30 extends laterally across the front surface and continues to extend down, and in some cases away from the back surface 16, but at a slightly steeper angle in the illustrated embodiment compared to the angle on the side surface 20, and then it extends straight across the front surface 18, generally parallel to the lower surface 26 and back surface 16. The releasable fastener 30 thus extends downwardly across the front surface 18, in a direction from one of the side surfaces 20, 22 to a center of said front surface 18 Once the fastener 30 approaches the opposed side surface 22, the fastener 30 extends in a symmetrical manner to that described above, thereby extending upwardly along part of the front surface 18 (and closer to the back surface 16 in some cases), and upwardly along entire width of the side surface 22 towards the end point 34.

In one embodiment, the fastener 30 is entirely spaced apart from, and no portion of the fastener 30 is located on, the upper surface 24 of the body 12 and/or the back surface 16. Instead, the fastener 30 extends, in one embodiment, only across the entirety and/or part of the front surface 18 and side surfaces 20, 22 in a continuous manner. In one case, the fastener 30 terminates at the end points 32, 34 on the sides surfaces 20, 22 or at the intersection of the back surface 16 and the side surfaces 20, 22, and no portion of the fastener 30 is positioned on the back surface 16. By avoiding having the fastener 30 "wrap around" to the back surface 16, the fastener 30 avoids having to make a tight turn upon which the fastener 30 can bind or get stuck, and also enables the length of a hinge line 40 (described below) on the back surface 16 to be maximized.

Figure 6:
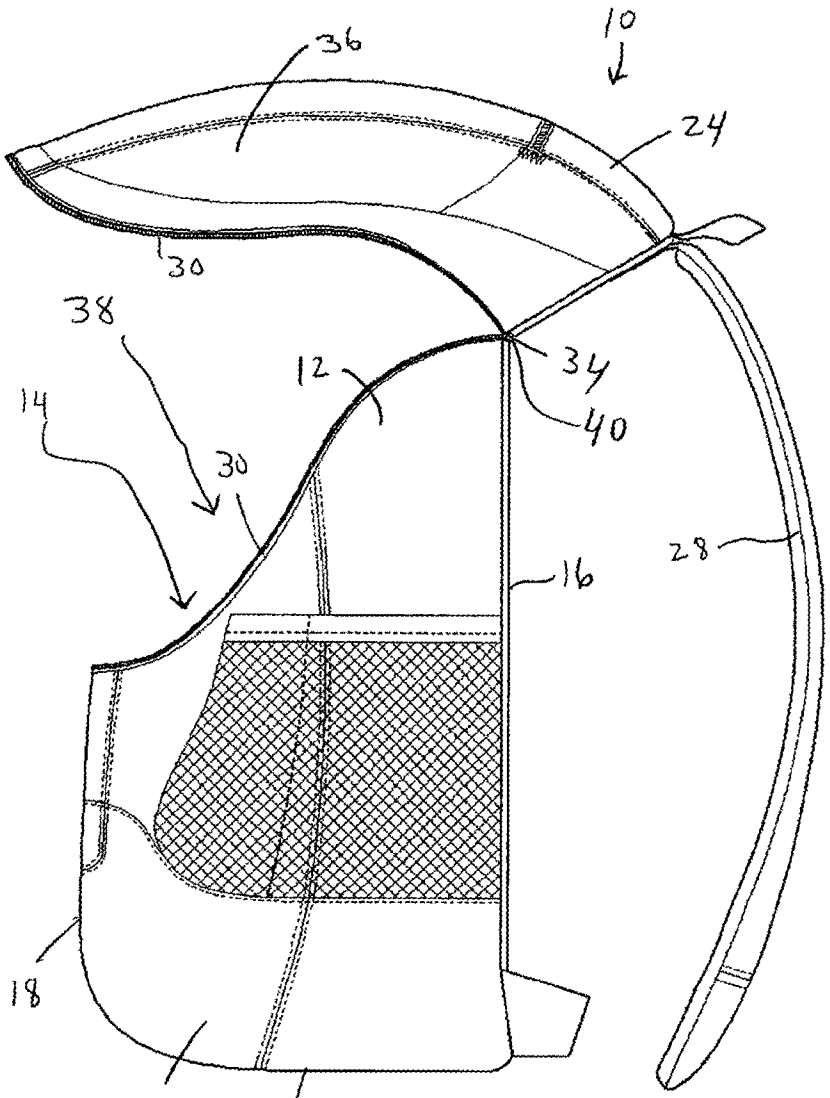
FIG. 6 is a side view of the backpack of FIG. 2.
Figure 5:
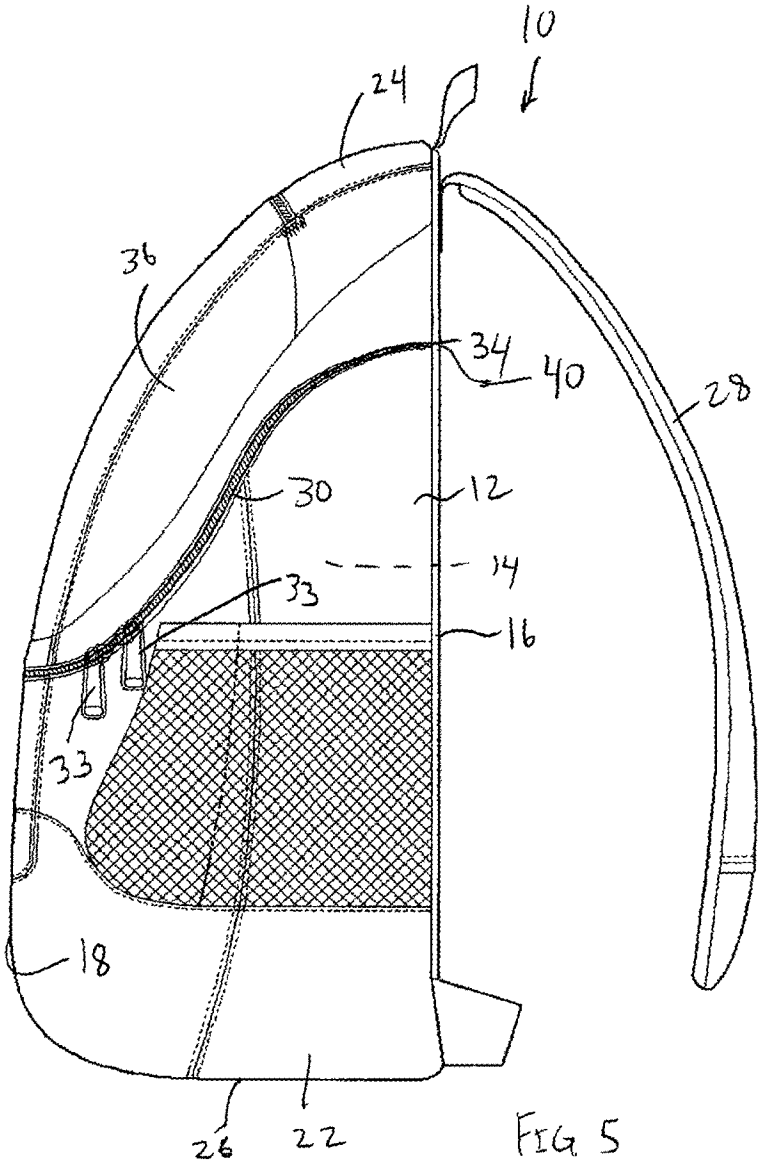
FIG. 5 is a side view of the backpack of FIG. 1.

When the fastener 30 is fully opened/released, the backpack 10 includes and/or the fastener 30 defines a cover 36 which is pivotable to a fully open position, or a partially open position, as shown in FIGS. 2 and 6. The cover 36, in the embodiment of FIGS. 1-6, includes an upper part of the side surfaces 20, 22, an upper part of the front surface 18, the entirety of the upper surface 24, and an upper part of the back surface 16. In this manner, when the cover 36 is pivoted open, the cover 36 provides a large mouth 38 providing access to the inner cavity 14.

As outlined above the fastener 30 can be angled such that at least part of the fastener 30 on either the side surfaces 20, 22 and/or front surface 18 extends at a non-perpendicular angle relative to the back surface 16 when the backpack 10 is viewed in side view and/or a non-parallel angle relative to the lower surface 26 when viewed in front view. For example, in the embodiment of FIGS. 1-6 and as outlined above, the entirety of the fastener 30 on the side surfaces 20, 22 extends at a downward angle (toward the lower surface 26) relative to the back surface 16 moving in a direction from the back surface 16 to the front surface 18. The fastener 30 can have this angled qualities at a center portion of the sides surfaces 20, 22, away from an outer perimeter of the side surfaces 20, 22 wherein the fastener 30 transitions from one surface/panel to another. It should be understood that such portions of the fastener 30 could also be curved, which is considered for the purposes of this document to be angled since the curved shape forms various differing angles at differing positions along the curve.

The fastener 30 or portions thereof may also be angled on the front surface 18 and extend at a non-perpendicular angle relative to the side surfaces 20, 22, and/or at a non-parallel angle relative to the lower surface 26, as shown in FIGS. 1-6, at portions spaced away from an outer perimeter of the front surface 18. The angled nature of the fastener 30 provides angled lower surfaces to the cover 36 and provides improved access by providing a larger surface area to the mouth 38 and easier access when opened. In addition, when the mouth 38 is angled upwardly (i.e. in the embodiment of FIGS. 1-6), the mouth 38 faces/is perpendicular to a user positioned above the backpack 10, providing ease of access such as when the backpack 10 is positioned on the ground and the user is positioned in front of the backpack 10.

Figure 4:
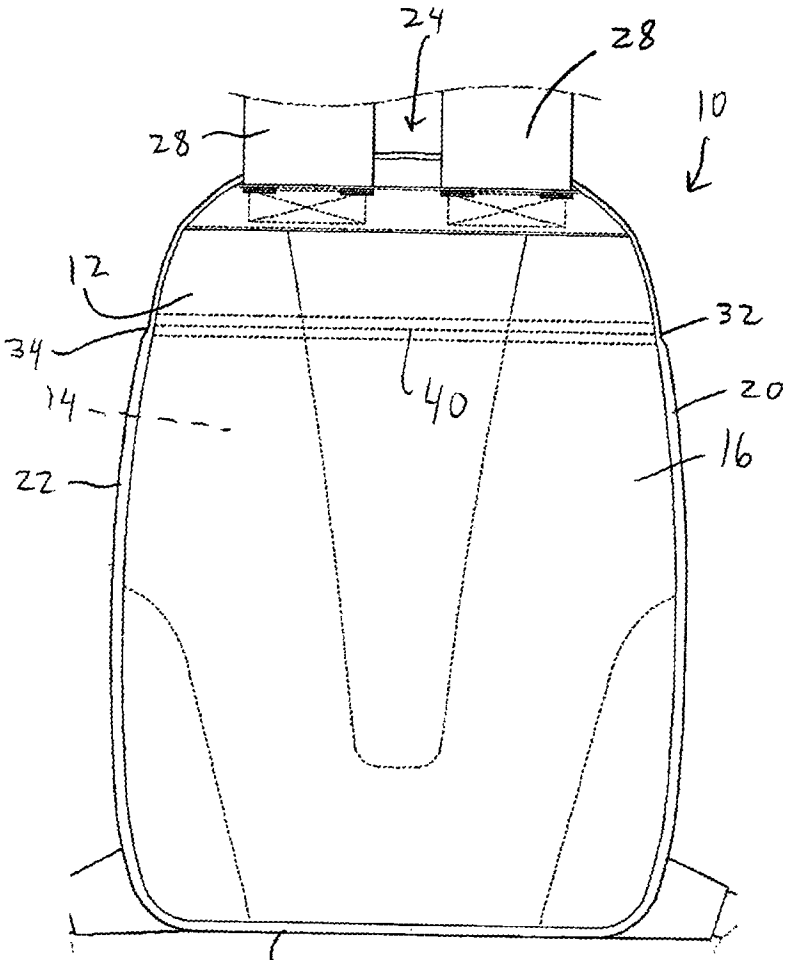
FIG. 4 is a back view of the backpack of FIG. 1.
Figure 3:
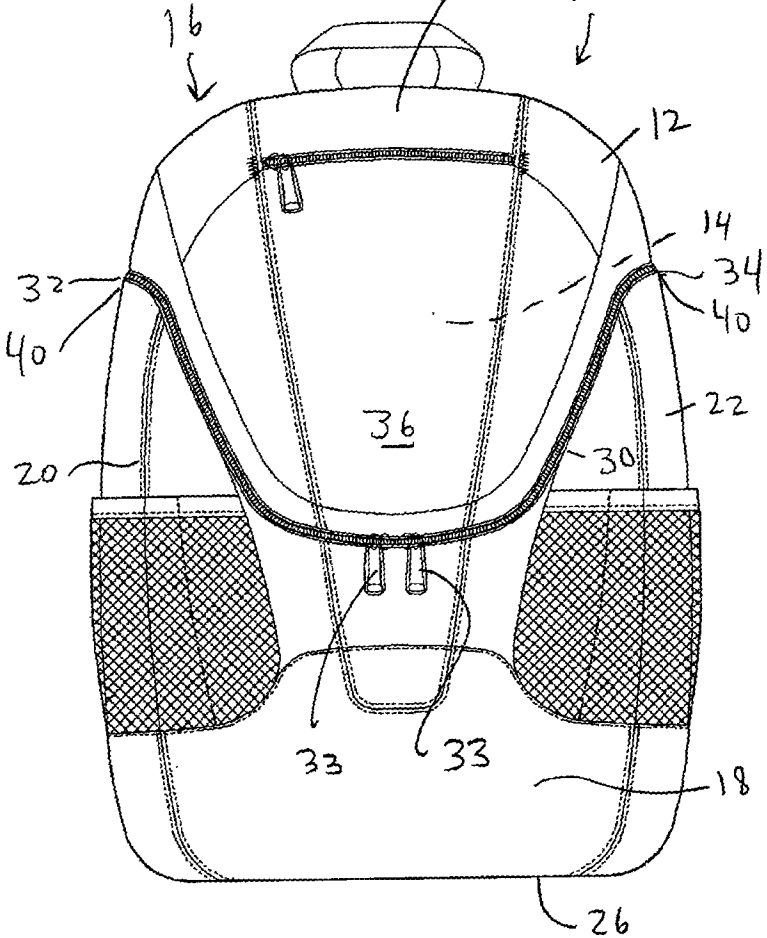
FIG. 3 is a front view of the backpack of FIG. 1.

In the embodiment of FIGS. 1-6 and best shown in FIGS. 2 and 4, the body 12/back surface 16 includes a hinge line 40 formed therein about which the body 12/cover 36/back surface 16 is predetermined to bend. For example, in one case, the hinge line 40 is a line of weakness such that the body 12/back surface 16 is weaker and/or thinner along the hinge line 40 as compared to other areas of the body 12/back surface 16, such as areas positioned adjacent to (but spaced apart from) the hinge line 40. The hinge 40 can be made of the same material as surrounding areas of the back surface 16, or at least the same outer-most material, but the material (such as inner stiffeners or the like) is thinned or weakened. The hinge 40 can be positioned below the shoulder straps 28, and the shoulder straps 28 positioned above the hinge 40, to enable the shoulder straps 28 to be positioned at an uppermost portion of the backpack 10 to provide desired weight-bearing characteristics.

In the illustrated embodiment, the hinge line 40 is positioned on the back surface 16 and the end points 32, 34 of the fastener 30 are positioned at or immediately adjacent to the hinge line 40 and/or the hinge line 40 is positioned between and/or defined by the end points 32, 34. The hinge line 40 may extend across the entire dimension (width) of the back surface 16 extending parallel or generally parallel to said hinge line 40, to provide a strong and robust hinge 40. In this manner, when the cover 36 is moved to its open position, the cover 36 pivots or is hingedly moveable about the hinge line 40 to provide ease of opening and/or fuller opening of the cover 36. In one embodiment, the hinge line 40 and/or end points 32, 34 are located in at least the upper one-half, or the upper one-third, of the body 12 so that contents stored in the backpack 10 do not spill out when the cover 36 is opened.

The hinge line 40 can be useful to aid in opening and closing the cover 36, particularly when the back surface 16 is made of relatively stiff material. However, the hinge line 40 is not necessarily required and can be omitted in some cases if desired. In the embodiment of FIGS. 1-6, the hinge line 40 is generally internally positioned on the back surface 16 such that the hinge line 40 does not extend along an outer perimeter of the back surface 16. However, if desired, the hinge line 40 can be positioned along an outer perimeter of the back surface 16 (e.g. along an upper edge thereof).

Figure 8:
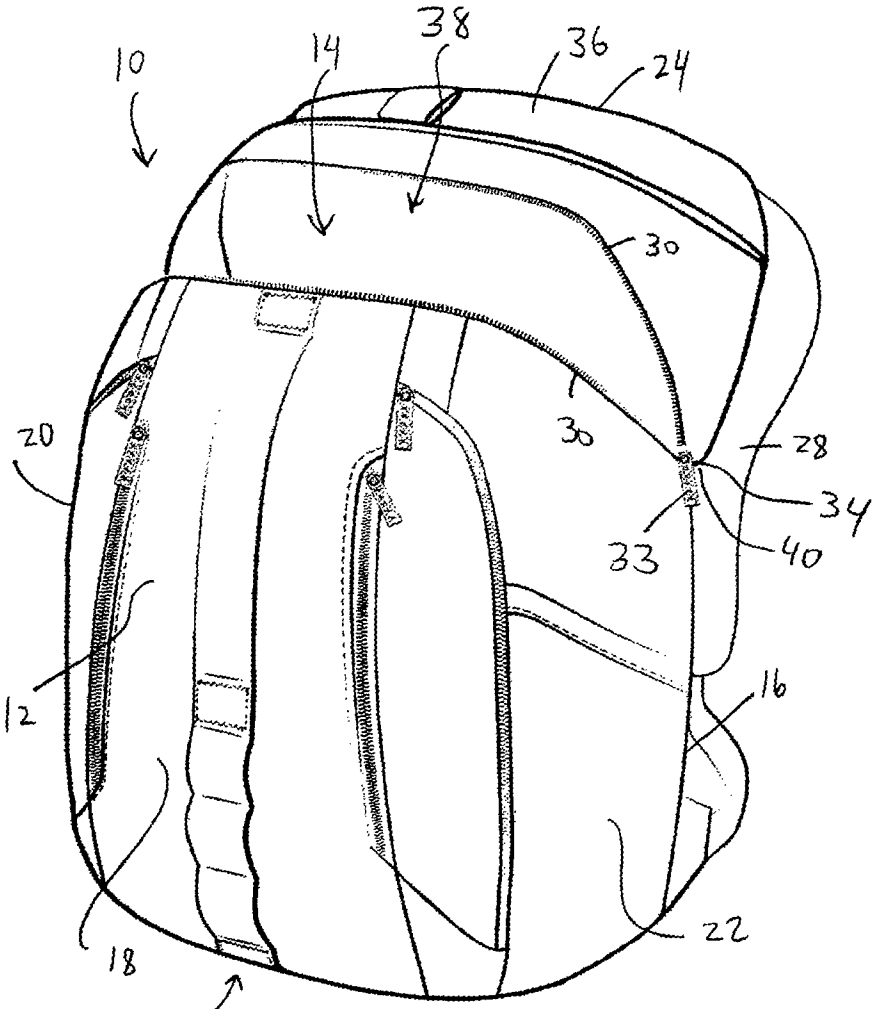
FIG. 8 is a right front perspective view of the backpack of FIG. 7, with the cover in a partially open position.
Figure 7:
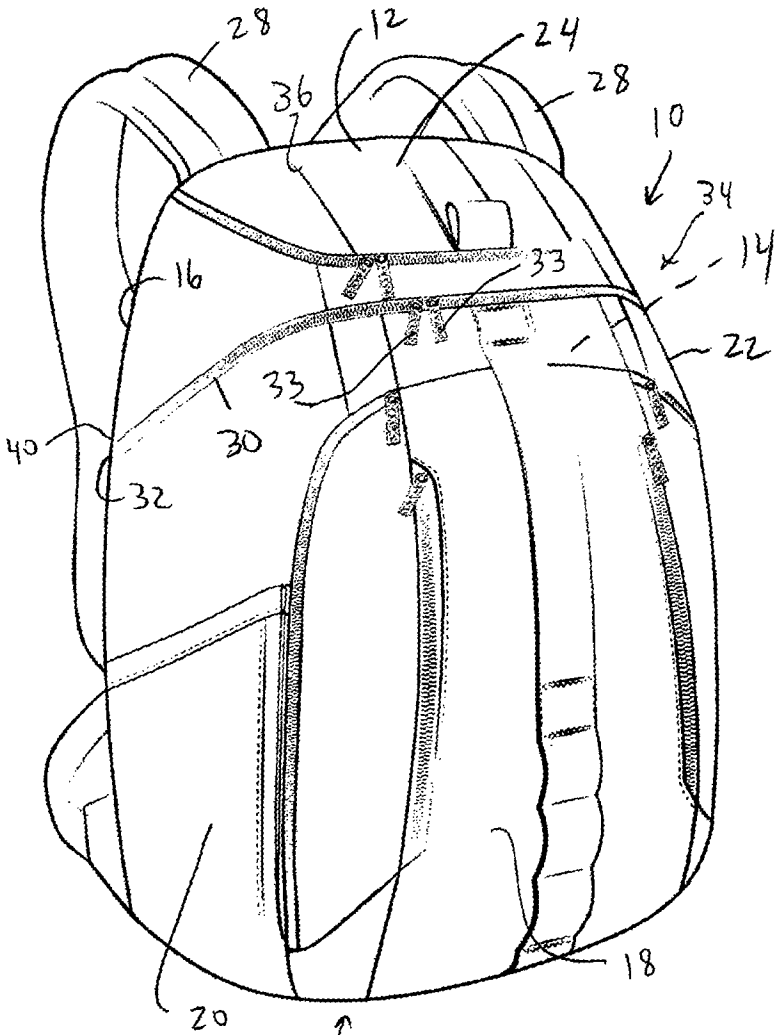
FIG. 7 is a left front perspective view of another embodiment of the backpack, with the cover in its closed position.

FIGS. 7 and 8 illustrate an alternate embodiment that is similar to the embodiment of FIGS. 1-6 above. However in this embodiment the fastener 30 extends upwardly (with respect to the lower surface 26) and away from the end point 32, and across the entire width of the side surface 20. The fastener 30 then extends laterally across the entire width of the front surface 18, generally parallel to the lower surface 26. The fastener 30 then extends downwardly across the entire width of the opposed side surface 22 to the end point 34. Further alternately, the fastener 30 can extend straight across the side surfaces 20, 22, perpendicular to the back surface 16. In this embodiment, the angled nature of the fastener 30 can provide a greater surface area to the mouth 38, as described above. In addition, when the mouth 38 is angled rearwardly, as in the embodiment of FIGS. 7 and 8, the mouth 38 faces/is perpendicular to a user positioned above and behind the backpack 10, providing ease of access.

In this manner, the cover 36 of the backpack 10 provides a relatively wide mouth 38 such that improved access to the inner cavity 14 is provided. The entire upper surface 24 can be included in the pivotable cover 36. In addition, since the fastener 30 is, in one embodiment, spaced away from the upper surface 24, the potential of water or moisture penetrating the fastener 30 is reduced, since the fastener 30 is spaced away from the upper surface 24 upon which moisture typically runs across and may be able to penetrate. The angled nature of the fastener 30 provides a mouth 38 of greater surface area that can be angled to provide ease of access.

Having described the invention in detail and by reference to the various embodiments, it should be understood that modifications and variations thereof are possible without departing from the scope of the claims of the present application.

The invention claimed is:

1. A backpack comprising:

a body including a back surface configured to be positioned adjacent to a back of a wearer when said backpack is worn, said body further including a front surface at least partially spaced away from said back surface to define an inner cavity therebetween, said inner cavity having an upper extent, said body further including a pair of opposed side surfaces, each side surface extending between said back surface and said front surface;

at least one shoulder strap coupled to said body and positionable over a shoulder of a wearer; and a releasable fastener that is openable to provide access to said inner cavity or closable to block access to said inner cavity, wherein said fastener extends at least partially across said front surface and both side surfaces, and wherein at least part of said releasable fastener on said side surfaces, at a position away from an outer perimeter of each side surface, extends at a non-perpendicular angle relative to said back surface;

wherein said body includes a hinge line about which said body is disposed to bend when said releasable fastener is opened, at least part of said hinge line being spaced away from said upper extent of said inner cavity, and wherein said backpack is configured such that when said releasable fastener is opened said backpack includes a cover at least partially defined by said releasable fastener that is hingedly movable relative to said hinge line.

2. The backpack of claim 1 wherein said hinge line is positioned on or adjacent to said back surface.

3. The backpack of claim 1 wherein said hinge line extends across an entirety of a width of said back surface, and wherein said width extends in a direction parallel to said hinge line.

4. The backpack of claim 1 wherein said releasable fastener does not extend across any of said back surface.

5. The backpack of claim 1 wherein said at least part of said releasable fastener on said front surface, at a position spaced away from an outer perimeter thereof, extends at a non-perpendicular angle relative to the said side surfaces, and wherein said releasable fastener includes a portion on said cover configured to releasably lockingly engage a portion on said body.

6. The backpack of claim 5 wherein said releasable fastener includes a zipper.

7. The backpack of claim 1 wherein said cover includes at least part of both of said side surfaces and at least part of said front surface.

8. The backpack of claim 1 wherein said front surface is generally parallel to said back surface.

9. The backpack of claim 1 wherein said body includes an upper surface extending between said back surface and said front surface and extending between said side surfaces, and wherein said releasable fastener is entirely spaced away from and not located on said upper surface.

10. The backpack of claim 1 wherein said hinge line is a line of weakness such that said body is at least one of weaker or thinner along said hinge line as compared to areas of said body adjacent to said hinge line.

11. The backpack of claim 10 wherein an outer surface of said hinge line is made of a same material as an outer surface of said areas of said body adjacent to said hinge line.

12. The backpack of claim 1 wherein said fastener includes a pair of spaced apart endpoints, and wherein each endpoint is positioned immediately adjacent to said hinge line on opposite ends thereof.

13. The backpack of claim 1 further comprising a lower surface extending between said back surface and said front surface and extending between said side surfaces.

14. The backpack of claim 13 wherein said fastener, on said side surfaces, extends generally at an angle relative to said lower surface.

15. The backpack of claim 13 wherein said fastener, on said side surfaces, extends away from said lower surface in a direction from said back surface to said front surface.

16. The backpack of claim 13 wherein said fastener, on said side surfaces, extends toward said lower surface in a direction from said back surface to said front surface.

17. The backpack of claim 1 wherein said shoulder strap is directly coupled to said back surface at a position above said hinge.

18. The backpack of claim 1 wherein said hinge line is generally internally positioned on said back surface such that said hinge line does not extend along an outer perimeter of said back surface.

19. The backpack of claim 1 wherein said fastener extends entirely across said front surface and both side surfaces.

20. The backpack of claim 1 wherein said fastener, at positions on both side surfaces adjacent to the outer perimeter of each side surface, extends generally perpendicularly away from said back surface.

21. The backpack of claim 1 wherein said back surface is a generally flat, planar panel.

22. The backpack of claim 1 wherein said releasable fastener extends downwardly across both side surfaces, in a direction away from said back surface, and wherein said releasable fastener extends downwardly across said front surface, in a direction from one of said side surfaces to a center of said front surface.

23. The backpack of claim 1 wherein said back surface defines a height of said inner cavity such that an upper extent of said back surface is coincident with said upper extent of said inner cavity, and wherein said hinge line is generally internally positioned on said back surface such that said hinge line does not entirely extend along an outer perimeter of said back surface.

24. The backpack of claim 1 wherein said back surface at least partially defines said inner cavity and has an outer perimeter, and wherein said hinge line is spaced away from said outer perimeter except at endpoints of said hinge line.

25. The backpack of claim 1 wherein said upper extent is an upper-most extent of said inner cavity with respect to a gravitational frame of reference when said backpack is worn.

26. The backpack of claim 1 wherein said at least part of the hinge line is vertically spaced away from the upper extent of said inner cavity.

27. The backpack of claim 1 wherein an entirety of the hinge line is vertically spaced away from the upper extent of said inner cavity.

28. A method for using a backpack comprising:

accessing a backpack including:

a body having a back surface configured to be positioned adjacent to a back of a wearer when said backpack is worn, said body further including a front surface at least partially spaced away from said back surface to define an inner cavity therebetween, said body further including a pair of opposed side surfaces, each side surface extending between said back surface and said front surface;

at least one shoulder strap coupled to said body and positionable over a shoulder of a wearer; and a releasable fastener that is openable to provide access to said inner cavity or closable to block access to said inner cavity, wherein said fastener extends at least partially across said front surface and both side surfaces, wherein at least part of said fastener extends upwardly or downwardly, wherein said body includes a hinge line about which said body is disposed to bend when said fastener is open, and wherein at least part of said hinge line is spaced away from an upper extent of said inner cavity; and opening said releasable fastener to define a cover which is hingedly movable relative to said hinge line.

29. A backpack comprising:

a body including a back surface configured to be positioned adjacent to a back of a wearer when said backpack is worn, said body further including a front surface at least partially spaced away from said back surface to define an inner cavity therebetween, said body further including a pair of opposed side surfaces, each side surface extending between said back surface and said front surface;

at least one shoulder strap coupled to said body and positionable over a shoulder of a wearer;

a releasable fastener that is openable to provide access to said inner cavity or closable to block access to said inner cavity, wherein said fastener extends at least partially across said front surface and both side surfaces and wherein at least part of said fastener extends upwardly or downwardly; and a hinge line about which said body is predetermined to bend, wherein said hinge line is a line of weakness such that said body is at least one of weaker or thinner along said hinge line as compared to areas of said body adjacent to said hinge line.

30. The backpack of claim 29 wherein at least part of the hinge line is positioned on said back surface.

31. The backpack of claim 30 wherein said backpack is configured such that when said releasable fastener is opened said backpack includes a cover at least partially defined by said releasable fastener that is hingedly movable relative to said hinge line.

32. A backpack comprising:

a body including a back surface configured to be positioned adjacent to a back of a wearer when said backpack is worn, said body including a front surface at least partially spaced away from said back surface to define an inner cavity therebetween, said body further including a pair of opposed side surfaces, each side surface extending between said back surface and said front surface;

at least one shoulder strap coupled to said body and positionable over a shoulder of a wearer; and a fastener that is openable to provide access to said inner cavity or closable to block access to said inner cavity, wherein said fastener extends at least partially across said front surface has been replaced with and both side surfaces and wherein the fastener, at the side surfaces, extends at a non-perpendicular angle relative to the back surface of the body;

wherein said backpack is configured such that when said fastener is opened said backpack includes a cover at least partially defined by said fastener and that is hingedly movable relative to a hinge line, said cover including at least part of both side surfaces, at least part of said front surface and at least part of said back surface, and wherein said at least one shoulder strap is attached to said body at a position above said hinge line.

33. A backpack comprising:

a body including a back surface configured to be positioned adjacent to a back of a wearer when said backpack is worn, said body including a front surface at least partially spaced away from said back surface to define an inner cavity therebetween, said body further including a pair of opposed side surfaces, each side surface extending between said back surface and said front surface;

at least one shoulder strap coupled to said body and positionable over a shoulder of a wearer; and a fastener that is openable to provide access to said inner cavity or closable to block access to said inner cavity, wherein said fastener extends at least partially across said front surface and both side surfaces;

wherein said backpack is configured such that when said fastener is opened said backpack includes a cover at least partially defined by said fastener and that is hingedly movable relative to a hinge line, said cover including at least part of both side surfaces, at least part of said front surface and at least part of said back surface, and wherein said at least one shoulder strap is attached to said body at a position above said hinge line and the hinge line is a line of weakness in the body that is at least one of weaker or thinner along the hinge line as compared to areas of the body adjacent the hinge line.

* * * * *